United States Patent [19]

Seevinck et al.

[11] Patent Number: 4,605,892

[45] Date of Patent: Aug. 12, 1986

[54] CURRENT-SOURCE ARRANGEMENT

[75] Inventors: Evert Seevinck, Delden; Adrianus J. M. Van Tuijl, Nijmegen, both of Netherlands

[73] Assignee: U.S. Philips Corporation, New York, N.Y.

[21] Appl. No.: 705,763

[22] Filed: Feb. 26, 1985

[30] Foreign Application Priority Data

Feb. 29, 1984 [NL] Netherlands ..... 8400636

[51] Int. Cl.[4] ..... G05F 3/20

[52] U.S. Cl. ..... 323/315; 323/269; 323/303

[58] Field of Search ..... 323/269, 312, 315, 316, 323/303; 307/296 R, 297

[56] References Cited

U.S. PATENT DOCUMENTS 4,172,992 10/1979 Culmer et al. ..... 323/316

4,443,753 4/1984 McGlinchey ..... 323/315 X

*Primary Examiner*—Peter S. Wong

*Attorney, Agent, or Firm*—Thomas A. Briody; William J. Streeter; Marianne R. Rich

[57] ABSTRACT

A current-source arrangement supplying a current which increases directly proportionally to the supply voltage ($V_S$) and which is suitable for operation with supply voltages above approximately 0.7 V, comprises a first resistor ($R_{10}=R$) in which a current $(V_S-V_{BE})/R$ flows, which current is supplied by a first transistor ($T_{10}$) via a first current-mirror circuit ($T_{11}$, $T_{12}$) and a second current-mirror circuit ($T_{13}$, $T_{14}$). A second resistor ($R_2=R$) is arranged in parallel with the base-emitter junction of the input transistor ($T_{11}$) of the first current-mirror circuit ($T_{11}$, $T_{12}$), through which second resistor ($R_2$) a current $V_{BE}/R$ flows which is supplied by the first transistor ($T_{10}$) via the collector-base interconnection of the input transistor ($T_{11}$). The total current flowing through the first transistor ($T_{10}$) is then equal to $V_S/R$. This current can be taken from the collector terminals (15A, 15B) of the transistors ($T_{15A}$, $T_{15B}$), whose base-emitter junctions are connected in parallel with the base-emitter junction of the first transistor ($T_{10}$).

7 Claims, 3 Drawing Figures

CURRENT-SOURCE ARRANGEMENT

Figure 1:
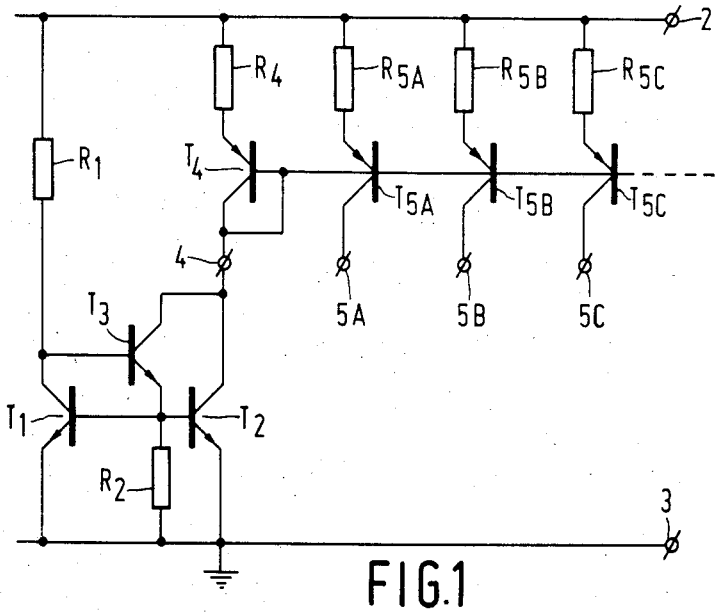

The invention relates to a current-source arrangement, which comprises the series arrangement of a first resistor and at least the base-emitter junction of a first transistor between a first and a second power-supply terminal.

Such a current-source arrangement may be used for general purposes in integrated circuits and in particular integrated amplifier circuits.

A current-source arrangement which is frequently used in amplifier circuits comprises a resistor and a diode-connected transistor arranged in series between the positive and the negative power supply terminal, a transistor whose base-emitter junction is connected in parallel with the base-emitter junction of the diode-connected transistor being provided for each current source required in the circuit.

Battery-powered amplifier circuits require current-source arrangements which operate at very low supply voltages. These supply voltages are of the order of 1.5 to 3 V. Generally, it also required that, these amplifier circuits can operate at higher supply voltages of, for example, 6 to 9 V. In view of the higher powers to be delivered at higher supply voltages the current-source arrangements must then be capable of supplying larger output currents. However, the known current-source arrangement is not very suitable for this purpose because the output current increases non-linearly with the supply voltage.

Therefore, it is the object of the invention to provide a current-source arrangement which is suitable for low supply voltages and which supplies an output current which increases as a linear function of the supply voltage. According to the invention a current-source arrangement of the type specified in the opening paragraph is characterized in that in an output current path a current is generated which is substantially equal to the current which flows through the first resistor multiplied by a constant factor, a current which flows through a second resistor across which a voltage is applied which is substantially equal to the voltage across the base-emitter junction of the first transistor being added to the current in said output current path, and the resistance value of the second resistor being substantially equal to the quotient of the resistance value of the first resistor and the product of the number of base-emitter junctions in the said series arrangement and the said multiplication factor. The non-linearity in the known current-source arrangement is caused by a current component which is equal to the quotient of the sum of the base-emitter voltages occurring in the series arrangement and the resistance value of the first resistor. In accordance with the invention the current through the series arrangement is generated in an output-current path, when ignoring a multiplication factor. The non-linear component in this current is compensated for by generating an identical current and adding this current to the current from the output-current path. The compensation current is generated by applying a voltage equal to the base-emitter voltage of the first transistor across a resistor having a resistance value equal to the quotient of the resistance value of the first resistor and the product of the number of base-emitter junctions in the series arrangement and the multiplication factor.

A first embodiment of the invention is characterized in that the second resistor and the base-emitter junction of a second transistor is arranged in parallel with the base-emitter junction of the first transistor and the base-emitter junction of a third transistor whose collector is connected to the collector of the second transistor is arranged between the collector and the base of the first transistor. The series arrangement now includes two base-emitter junctions. The multiplication factor in this embodiment is equal to the ratio between the emitter areas of the second and the first transistor. In the case of equal emitter areas the current through the output current path is equal to the current in the series arrangement. In the last-mentioned case the resistance value of the second resistor must be substantially equal to half the resistance value of the first resistor. In the case of different emitter areas the resistance value of the second resistor must be reduced by the multiplication factor. The minimum supply voltage required for this arrangement is equal to two base-emitter voltages.

A second embodiment of the invention is characterized in that the output-current path comprises the collector of the first transistor, which collector is coupled to the input of a first current-mirror circuit which comprises a second transistor with a low-impedance connection between the collector and the base, the second resistor and the base-emitter junction of a third transistor being arranged in parallel with the base-emitter junction of the second transistor, which third transistor has its collector coupled to the input of a second current-mirror circuit whose output is coupled to the base of the first transistor. As in this embodiment the series arrangement includes one base-emitter junction this embodiment is suitable for operation with very low supply voltages up from substantially 0.7 V.

Figure 2:
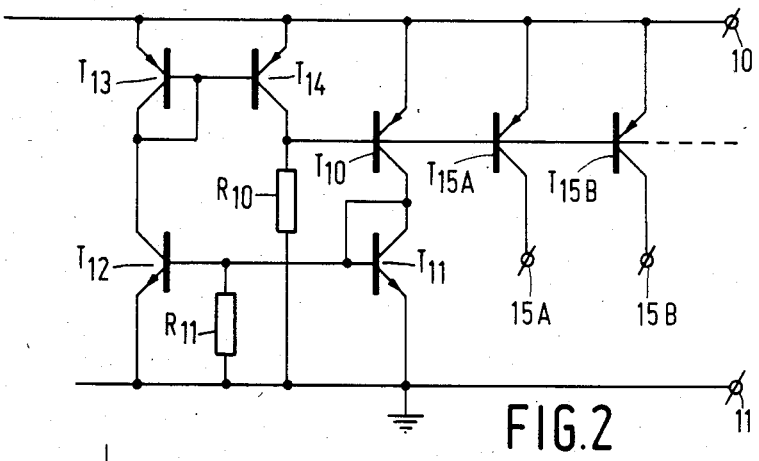
Figure 3:
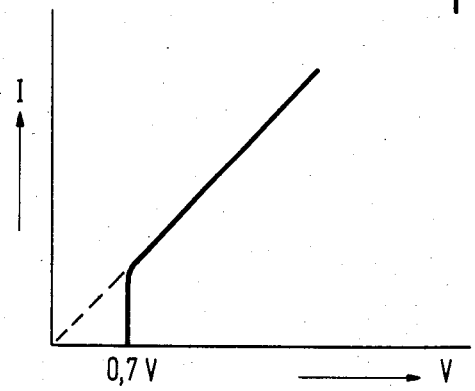

The invention will now be described in more detail, by way of example, with reference to the drawing, in which:

FIG. 1 shows a current-source arrangement which is a first embodiment of the invention, FIG. 2 shows a current source arrangement which is a second embodiment of the invention, and FIG. 3 shows a current-voltage characteristic of the arrangement shown in FIG. 2.

FIG. 1 shows a current source arrangement which is a first embodiment of the invention. The arrangement comprises the series arrangement of a resistor $R_1=R$, the base-emitter junction of a transistor $T_3$, and the baseemitter junction of a transistor $T_1$ between the positive power-supply terminal 2 and the negative power-supply terminal 3, in the present case earth, the base and the emitter of transistor $T_3$ being connected to the collector and the base, respectively, of transistor $T_1$. A resistor $R_2=R/2$ and the base-emitter junction of a transistor $T_2$ are arranged in parallel with the base-emitter junction of transistor $T_1$. In the present example the emitter area of transistor $T_2$ is equal to that of transistor $T_1$. The collector of transistor $T_3$ is connected to the collector of transistor $T_2$. Further, the collector of transistor $T_2$ is connected to the input 4 of a multiple current mirror which is shown in simplified form. The current mirror comprises a PNP-transistor $T_4$ connected as a diode, a resistor $R_4$ being included in its emitter circuit. The base of transistor $T_4$ is connected to the bases of a plurality of transistors $T_{5A}$, $T_{5B}$ and $T_{5C}$, resistors $R_{5A}$, $R_{5B}$ and $R_{5C}$ being arranged in the respective emitter circuits. The supply-voltage dependent current can be taken from the collector terminals 5A, 5B and 5C. It is to be noted that the resistors $R_4$, $R_{5A}$, $R_{5B}$ and $R_{5C}$ are not essential and merely serve to improve the equality of the output currents. The circuit arrangement operates as follows. If the supply voltage is $V_S$ the current flowing in the resistor $R_1$ is equal to $(V_S-2V_{BE})/R$. By means of the current mirror comprising the transistors $T_1$, $T_2$ and $T_3$, of which transistors $T_1$ and $T_2$ have equal emitter areas, this current is reproduced in the collector circuit of transistor $T_2$. The base-emitter voltage of transistor $T_1$ appears across the resistor $R_2$, so that a current $2V_{BE/R}$ flows through this resistor. This current is supplied by transistor $T_3$. When the base currents of transistors $T_1$ and $T_2$ are ignored, the current which flows in the collector circuit of transistor $T_3$ is also $2V_{BE}/R$. This current is added to the collector current of transistor $T_2$, so that the common collector current of transistors $T_2$ and $T_3$ is equal to $V_S/R$. This current, which increases as a linear function of the supply voltage, is applied to the input 4 of the current-mirror circuit, so that currents which increase as linear functions of the supply voltage are available on outputs 5A, 5B and 5C, the absolute values of the currents being dependent on the ratio between the respective resistor $R_{5A}$, $R_{5B}$ and $R_{5C}$ and the resistor $R_4$. The minimum supply voltage required for the arrangement is equal to two base-emitter voltages ($\approx$1.4 V). This is the voltage above which a current will flow in the resistor $R_1$. In the example described the emitter area of transistor $T_2$ is equal to that of transistor $T_1$, so that the collector current of transistor $T_2$ is substantially equal to the collector current of transistor $T_1$. However, alternatively different emitter areas may be chosen for the transistors $T_1$ and $T_2$. The resistance value of resistor $R_2$ must then be divided by a factor equal to the ratio between the emitter areas of the transistors $T_2$ and $T_1$. If, for example, the emitter area of transistor $T_2$ is twice as large as that of transistor $T_1$, the collector current of transistor $T_2$ will be twice as large as that of transistor $T_1$, so that the non-linear term in this current will also be twice as large. This non-linearity is then compensated for by reducing the resistance value of the resistor $R_2$ by a factor of two. It will be evident that the arrangement may be equipped with PNP transistors instead of NPN transistors and NPN transistors instead of PNP transistors. Moreover, it is not necessary to apply the common collector current of transistors $T_2$ and $T_3$ to a current mirror circuit. As an alternative, this current may be applied directly to a load.

A current-source arrangement which is a second embodiment of the invention will be described with reference to FIG. 2. Between the positive power-supply terminal 10 and the negative power-supply terminal 11, in the present case earth, the current-source arrangement comprises the series arrangement of the base-emitter junction of a transistor $T_{10}$ and a resistor $R_{10}=R$. The collector of transistor $T_{10}$ is connected to the input of a first current-mirror circuit comprising a transistor $T_{11}$ connected as a diode and a transistor $T_{12}$ whose base-emitter junction is arranged in parallel with that of transistor $T_{11}$. In the present example the emitter area of transistor $T_{11}$ is equal to that of transistor $T_{12}$. A resistor $R_{11}=R$ is connected between the base and the emitter of transistor $T_{11}$. The collector of transistor $T_{12}$ is connected to the input of a second current-mirror circuit comprising a transistor $T_{13}$ connected as a diode and a transistor $T_{14}$ whose base-emitter junction is connected in parallel with that of transistor $T_{13}$ and whose collector is connected to the base of transistor $T_{10}$. Transistors $T_{13}$ and $T_{14}$ have equal emitter areas. A current which increases as a linear function of the supply voltage is available on the collector terminals 15A and 15B of transistors $T_{15A}$ and $T_{15B}$, whose bases are connected to that of transistor $T_{10}$. The arrangement then operates as follows When a supply voltage $V_S$ is applied across the circuit arrangement a current will flow through the series arrangement of the base-emitter junction of transistor $T_{10}$ and resistor $R_{10}$, which current is equal to $(V_s-V_{BE})/R$. This current is amplified after which it flows in the collector circuit of transistor $T_{10}$ and is applied to the resistor $R_{10}$ via the first current-mirror circuit $T_{11}$, $T_{12}$ and via the second current-mirror circuit $T_{13}$, $T_{14}$. The base-emitter voltage of transistor $T_{11}$ appears across resistor $R_{11}$, so that a current $V_{BE}/R$ flows through this resistor. This current is supplied by transistor $T_{10}$ via the collector-base interconnection of transistor $T_{11}$. Since transistor $T_{10}$ must also supply the current which is to be supplied to the resistor $R_{10}$ via the current mirrors $T_{11}$, $T_{12}$ and $T_{13}$, $T_{14}$, a total current equal to $V_S/R$ will flow in the collector of transistor $T_{10}$ when the base currents of transistors $T_{11}$ and $T_{12}$ are ignored. This total current increases directly in proportion to the supply voltage. The arrangement is suitable for use at very low supply voltages because the circuit arrangement can operate for supply voltages higher than one base emitter voltage plus the saturation voltage of a transistor, defined as a lower limit voltage ($\approx$0.7 V). FIG. 3 shows the current-voltage characteristic of the arrangement. The voltage-dependent current $V_S/R$ can be taken from the collector terminals 15A and 15B of the transistors $T_{15A}$ and $T_{15B}$. In the present example transistors $T_{11}$ and $T_{12}$, as well as transistors $T_{13}$ and $T_{14}$, have equal emitter areas, so that the collector current of transistor $T_{10}$ is equal to the current through resistor $R_{10}$. However, transistors $T_{11}$ and $T_{12}$, as well as transistors $T_{13}$ and $T_{14}$, may have different emitter areas. The collector current of transistor $T_{10}$ is then equal to the product of the overall gain factor of the current mirrors $T_{11}$, $T_{12}$ and $T_{13}$, $T_{14}$ and the current through resistor $R_{10}$. The resistance value of resistor $R_{11}$ must then be reduced by this factor. In the same way as in the arrangement shown in FIG. 1, the NPN transistors may be replaced by PNP transistors and the other way round. Moroever, resistors of equal value may be arranged in the emitter circuits of transistors $T_{11}$ and $T_{12}$ and any other known current mirror arrangement may be used for the current mirror circuit $T_{13}$, $T_{14}$.

The invention is not limited to the aforementioned embodiments. Within the scope of the present invention other current-source arrangements based on the same principle can be designed by those skilled in the art.

What is claimed is:

1. A current-source circuit operable between two power supply terminals, said power supply terminals being adapted to be connected to a supply voltage, comprising in combination a first resistor of a predetermined resistance value, a first transistor having a collector, and a base-emitter junction connected in series with said first resistor, and wherein a base-emitter voltage appears across said base-emitter junction, the series combination of said first resistor and said base-emitter junction being connected across said power supply terminals, first current mirror circuit means having an input thereof coupled to the collector of said first transistor, and having a first current multiplication factor, said first current mirror circuit means having a second transistor, said second transistor having a base emitter junction and a collector, a low-impedance connection existing between the base and the collector of said second transistor, and a third transistor having a collector and a base-emitter junction, said base emitter junction being connected in parallel with the base-emitter junction of said second transistor, a second resistor being connected in parallel with the base-emitter junction of said second transistor, said second and third transistors, and said second resistor being connected to one of said terminals, said first transistor defining a saturation voltage, and second current mirror circuit means connected to the other of said power supply terminals, having an input thereof coupled to the collector of said third transistor, having an output thereof coupled to the base of said first transistor, and having a second current multiplication factor, said second resistor having a resistance value substantially equal to the quotient of said first resistor value, and the product of (a) the base-emitter voltage of said first transistor, (b) said first current multiplication factor and (c) said second current multiplication factor, whereby said current-source circuit may supply a current substantially proportional to supply voltages which exceed a voltage substantially equal to the base emitter voltage plus the saturation voltage.

2. The current-source circuit as set forth in claim 1, wherein said first transistor is a p-n-p transistor, while said second and third transistors are n-p-n transistors.

3. The current-source circuit as set forth in claim 1, wherein said first transistor is an n-p-n transistor, while said second and third transistors are p-n-p transistors.

4. The current-source circuit as set forth in claim 1, wherein said second transistor operates as a diode.

5. The current-source circuit as set forth in claim 1, wherein said second and third transistors have substantially equal emitter areas.

6. The current-source circuit as set forth in claim 1, wherein the collector of said second transistor and the other of said power supply terminals constitute the input of said first current mirror circuit means.

7. The current-source circuit as set forth in claim 1, wherein said second transistor is unidirectional, and wherein said low impedance connection is a short circuit.

* * * * *